US007603872B2

(12) United States Patent
Tanaami et al.

(10) Patent No.: US 7,603,872 B2
(45) Date of Patent: Oct. 20, 2009

(54) HEAT-PUMP HOT WATER SUPPLY APPARATUS

(75) Inventors: Taichi Tanaami, Sano (JP); Masahiko Gommori, Ohira (JP); Kazuhiro Endoh, Kasumigaura (JP); Junichi Takagi, Kiryu (JP); Kouichi Fukushima, Tochigi (JP)

(73) Assignee: Hitachi Appliances, Inc., Tokyo (JP)

( * ) Notice: Subject to any disclaimer, the term of this patent is extended or adjusted under 35 U.S.C. 154(b) by 595 days.

(21) Appl. No.: 11/339,790

(22) Filed: Jan. 26, 2006

(65) Prior Publication Data

US 2006/0213209 A1 Sep. 28, 2006

(30) Foreign Application Priority Data

Mar. 24, 2005 (JP) ..... 2005-085180

(51) Int. Cl.
*F25B 27/00* (2006.01)

(52) U.S. Cl. ..... 62/238.7; 62/225; 62/324.6

(58) Field of Classification Search ..... 62/222–225, 62/238.6–238.7, 226, 228.1, 324.6, 217
See application file for complete search history.

(56) References Cited

U.S. PATENT DOCUMENTS

| | | | | |
|---|---|---|---|---|
| 2,102,940 | A * | 12/1937 | Buchanan | 237/19 |
| 4,100,762 | A * | 7/1978 | Davis et al. | 62/160 |
| 5,303,562 | A | 4/1994 | Bahel et al. | |
| 6,266,968 | B1 * | 7/2001 | Redlich | 62/204 |
| 6,418,737 | B1 | 7/2002 | Kuroki et al. | |
| 6,735,967 | B1 * | 5/2004 | Bischel et al. | 62/196.4 |
| 7,185,505 | B2 * | 3/2007 | Kamimura | 62/238.7 |
| 2003/0178498 | A1 | 9/2003 | Saitoh et al. | |

(Continued)

FOREIGN PATENT DOCUMENTS

| | | |
|---|---|---|
| CN | 1031055 | 2/1989 |

(Continued)

OTHER PUBLICATIONS

Search Report issued in European Patent Application No. 06001847.0 on Jul. 10, 2009.

*Primary Examiner*—William E Tapolcai
(74) *Attorney, Agent, or Firm*—Antonelli, Terry, Stout & Kraus, LLP.

(57) ABSTRACT

A heat-pump hot water supply apparatus, for dissolving problems of delaying in heating rise-up time when re-starting, and ill influences upon starting characteristics, due to liquid refrigerant residing in an evaporator when the operation is stepped, within a heat-pump circuit thereof, comprises a heat-pump refrigerant circuit, in which a compressor, a water/refrigerant heat exchanger, a refrigerant adjusting valve, and an evaporator, in series, through refrigerant pipes, a direct hot-water supply circuit, into which is supplied hot water heated, obtained by heating water supplied from an outside via a water pipe by means the water/refrigerant heat exchanger, and a compressor operation controller means for stopping the compressor and also closing the refrigerant adjusting valve when the compressor stops the operation thereof, and for re-starting the compressor after opening the refrigerant adjusting valve when the compressor starts the operation, again, wherein the refrigerant within the evaporator is collected to the compressor side when the operation is stopped, and after stopping, front and back of the evaporator is brought into a sealed condition by means of a refrigerant adjusting valve and a back-flow preventing valve, thereby preventing the refrigerant from residing within the evaporator.

23 Claims, 8 Drawing Sheets

U.S. PATENT DOCUMENTS

| | | | |
|---|---|---|---|
| 2004/0103677 | A1 | 6/2004 | Hirota |
| 2004/0144528 | A1 | 7/2004 | Kunimoto et al. |
| 2005/0132732 | A1 | 6/2005 | Eisenhower et al. |

FOREIGN PATENT DOCUMENTS

| | | |
|---|---|---|
| CN | 2200083 | 6/1995 |
| CN | 1445485 | 10/2003 |
| DE | 100 43 169 | 4/2001 |
| EP | 0 692 687 | 1/1996 |
| EP | 1 167 896 | 1/2002 |
| JP | 04-090454 | 3/1992 |
| JP | 07-019620 | 1/1995 |
| JP | 07-248164 | 9/1995 |
| JP | 10-205895 | 8/1998 |
| JP | 2002-318016 | 10/2002 |
| JP | 2003-106689 | 4/2003 |
| JP | 2003-240344 | 8/2003 |
| JP | 2003-279133 | 10/2003 |

* cited by examiner

HEATING LOAD CONDITION AND COMPRESSOR ROTATION SPEED TABLE (EXAMPLE)

UNIT: rpm

| | | TEMPERATURE OF WATER SUPPLY | | | |
|---|---|---|---|---|---|
| | | 9℃ | 17℃ | 24℃ | 30℃ |
| TEMPERATURE OF HOT-WATER SUPPLY | 42℃ | 4,000 | 3,000 | 2,000 | 1,000 |
| | 60℃ | 5,000 | 4,000 | 3,000 | 2,000 |
| | 85℃ | 6,000 | – | – | – |

HEAT-PUMP HOT WATER SUPPLY APPARATUS

BACKGROUND OF THE INVENTION

The present invention relates to a heat-pump hot water supply apparatus.

In general, a heat-pump water heater or hot water supply apparatus of the conventional art is of a hot-water storage type, having a large-size hot-water storage therewith, from 300 L to 500 L of in the capacity thereof, in the similar manner to an electric water heater or hot-water supplier, wherein hot water stored is supplied for use during the day-time, while boiling the water by means of a heat pump circuit during the nighttime with using discounted cheap electricity, which is cheap in the night, to be stored in the storage tank.

In recent years, a heat-pump water heater or hot water supply of an instantaneous heating type is proposed, finally, in which the water is heated, directly, to be supplied through a heat-pump operation, every time when using the hot water.

Such the heat-pump water heater of an instantaneous heating type, disclosed in the following Patent Document 1, for example, has no storage tank therein, so as to build up a main body of the water heater and a main body of the heat pump as a unit, and thereby obtaining a light weight, and space saving of an area where the it is installed.

Patent Document 1: Japanese Patent Laying-Open No. 2003-240344 (2003)

With the heat-pump water heater of an instantaneous heating type, being disclosed in the Patent Document 1, there is still remained a problem unsolved, in the rise-up characteristics or property thereof, i.e., it takes a long time to start up heating just after the operation thereof, being an important problem for the heat-pump hot water supply apparatus of an instantaneous heating type.

For achieving such instantaneous heating type heat-pump water heater, it is important to stabilize the starting characteristics or property, since the heating operation must be conducted, intermittently, every time when supplying the hot water. In particular, when it is stopped in the winter season, a large amount of refrigerant resides within an evaporator in the form of liquid. And, just after starting of the operation, the liquid refrigerant flows out, suddenly, into a compressor, so that it obstructs the starting operation; therefore, it is necessary to work out a countermeasure for such phenomenon, i.e., so-called a sleep in low-temperature (hereinafter, low-temperature sleep) condition. However, no measure is disclosed for dissolving such the problems, in the instantaneous heating type heat-pump water heater shown in the Patent Document 1.

Thus, with the instantaneous heating type heat-pump water heater of the Patent Document 1, the refrigerant is liquefied within the evaporator, radiating heat thereof, during stoppage of the compressor; however, it takes a time from 5 to 6 minutes from the time when a cock of water service is opened up to the time when a hot water of proper temperature (about 42° C.) comes out therefrom, in the winter season, i.e., so as to heat that liquefied refrigerant into a condition for heating the water by the heat-pump circuit. Also, there is provided no countermeasure for improving the characteristics of the low-temperature sleep mentioned above;

therefore, it is very difficult to put the heat-pump water heater into a practical use thereof.

BRIEF SUMMARY OF THE INVENTION

According to the present invention, for dissolving such the problems of the conventional art, an object thereof is to provide an instantaneous type heat-pump hot water supply apparatus, having no necessity of provision of the hot water storage of large capacity, achieving an improvement on shortening of the start-up time, as well as, on the low-temperature sleep characteristics, being the important problems to be dissolved, and thereby providing an instantaneous type heat-pump hot water supply apparatus having superior usability.

According to the present invention, analysis is made on the operation characteristics after the low-temperature sleep, as a means for dissolving delay in heating during the start-up time, within the conventional heat-pump hot water supply apparatus, and it is found out that an amount of the refrigerant residing within the evaporator has influences, largely, other than the time necessary for heating up the heat-pump cycle itself.

Thus, it is found out that lessening or reducing the amount of refrigerant residing within the evaporator enables to improve the start-up characteristics of the compressor, as well as, fasten an increase of heating temperature after start-up, and also shortening the delay time on heating when the heat-pump heater starts up, and that it has an effect, in particular, when temperature is low and where the delay in heating is long.

According to the present invention, upon basis of the result of study mentioned above, an improvement is made upon shortening of the rise-up time and the low-temperature sleep characteristics, by lessening or reducing the amount of refrigerant residing within the evaporator, and thereby providing an instantaneous type heat-pump hot water supply apparatus having superior usability.

For accomplishing the object mentioned above, according to the present invention, there is provided a heat-pump hot water supply apparatus, comprising: a heat-pump circuit connecting a compressor, a water/refrigerant heat exchanger for conducting heat exchange between the refrigerant compressed in said compressor and water, a refrigerant adjusting device for decompressing of the refrigerant through open/close of a flow passage of the refrigerant after conducting heat exchange with the water and closing the flow passage when said compressor stops operation thereof, and an evaporator for conducting heat exchange between the refrigerant decompressed and an air, in series, through refrigerant pipes, respectively; and a hot water supply circuit having a water supply pipe for supplying water into said water/refrigerant heat exchanger, and a hot water supplying pipe for supplying the water heated within said water/refrigerant heat exchanger.

With provision of those structures, since the compressor is stopped and at the same time the refrigerant adjusting valve is also closed when the heat-pump operation is stopped in the hot-water supply operation, the refrigerant can be prevented from flowing from the water/refrigerant heat exchanger into the evaporator under the stopping condition, and also to lessen an amount of refrigerant residing within the evaporator.

Also, in addition to the structures mentioned above, the heat-pump hot water supply apparatus, according to the present invention, wherein said refrigerant adjusting device opens the flow passage of the refrigerant when said compressor starts the operation thereof, thereby enabling to reduce the discharge pressure before starting the compressor, so as to start up the compressor, smoothly.

For example, operating the compressor after the refrigerant adjusting device opens the refrigerant flow passage enables to lower the discharge pressure before starting the compressor, and thereby enabling starting of the compressor, smoothly.

Next, in addition to the heat-pump apparatus as was mentioned previously, an order is changed between start of operation of said compressor and opening of the refrigerant flow passage of said refrigerant adjusting device, depending upon pressure difference between discharge side pressure and suction side pressure of said compressor, when said compressor stars the operation thereof; therefore it enables appropriate control, depending on the difference in pressures of the refrigerant in front and back the compressor when it is operated, again, being different from upon the peripheral temperature and/or times of operation/stoppage, etc. For example, an improvement is obtained on starting characteristics of the compressor, and also on rise-up characteristics of heating capacity.

The compressor is operated after opening the refrigerant adjusting valve, when the pressure difference is large, i.e., the load on the compressor is heavy, on the other hand, when the pressure difference is small, i.e., the load on the compressor is light, the refrigerant adjusting valve is opened after the compressor is operated. With doing this, it is possible to obtain both an improvement on the re-start characteristics and an improvement on heating operation rise-up characteristics of the compressor.

Also, there may be a time difference between the time when starting operation of said compressor and the time when opening the refrigerant flow passage by means of said refrigerant adjusting device. With provision of this time difference, it is possible to conduct the start of the compressor, with much certainty. Also, this time difference may be determined upon an outside air temperature when starting the supply of hot water, the compressor temperature, and the pressure difference of the compressor. With this, it is possible to obtain an improvement on the re-start characteristics by taking both the season factors and factors of time of stopping operation into the consideration.

Further, in addition to the structures mentioned above, the heat-pump hot water supply apparatus, according to the present invention, comprises a back-flow preventing valve for preventing the refrigerant from flowing from said compressor into said evaporator, within the refrigerant pipe provided between said evaporator of said heat-pump circuit and said compressor, and thereby further enables to prevent the refrigerant from flowing into the evaporator and reduce the amount of liquid refrigerant residing within the evaporator.

With this, an open/close valves are provided in front and back of the evaporator, wherein both the refrigerant adjusting valve and the back-flow preventing valve are opened so that the refrigerant can circulate during the operation, and when stopping, both the refrigerant adjusting valve and the back-flow preventing valve are closed, after the refrigerant within the evaporator is collected into a side of the compressor, so that the refrigerant can be prevented from flowing into the evaporator, and thereby enabling to obtain an improvement on the operation rise-up characteristics.

This back-flow preventing valve may be a check valve. Without using an electromagnetic coil, the valve is opened during the operation, so as to circulate the refrigerant due to the pressure difference between the suction-side pressure of the compressor and the evaporator-side pressure, and when stopping, after the refrigerant within the evaporator is collected into the side of compressor, the check valve is closed together with the stoppage of compressor, and thereby enables to bring the evaporator into a condition of being hermetically closed.

Also, the back-flow preventing valve may be an electromagnetic two-way valve. Though the electromagnetic two-way valve needs an electromagnetic coil, comparing to the check valve, however it can be controlled electrically irrespective of the pressure; therefore, it is possible to select a timing of closing freely, and it also enable to lessen an amount of refrigerant, leaking when it closes, to be extremely small, with a simple structure of using a ball valve, etc.

Further, in addition to the heat-pump hot water supply apparatus as was mentioned above, a water supply pipe is connected to a water supply duct outside the apparatus and the hot-water supply pipe is connected to a hot-water tapping terminal outside the apparatus, thereby building up a direct hot-water supply circuit, with which the water directly supplied can be to supplied as hot water. With this, comparing to the conventional hot-water storage type heat-pump hot water supply having the hot-water storage tank of a large capacity, it is possible to remove the loss due to heat radiation from the hot-water storage tank for storing therein the hot-water boiled up to high-temperature.

Also, by reducing an amount of refrigerant residing within the evaporator, according to the present invention, it is possible to achieve improvements on the heating rise-up characteristics when re-starting the operation, being an important problem to be dissolved for the instantaneous type heat-pump hot water supply apparatus, and also the re-start and the low-temperature sleep, as well, thereby enabling commercialization of the heat-pump hot water supply apparatus without a tank.

Further, when supplying hot water through direct heating by means of the water/refrigerant heat exchanger, instantaneously, it is possible to supply necessary hot water with the lowest input, with conducting a power control of the heat-pump circuit, so as to obtain the hot water of temperature to be tapped or supplied, and therefore it is possible to achieve the heat-pump hot water supply apparatus, having a very high efficiency and preferable or superior usability.

Also, with this direct hot water tapping type heat-pump hot water supply apparatus, it may be considered that the heat-pump circuit is late in rise-up or start thereof, comparing to that of a gas instantaneous water heater able to obtain high amount of heat through burning. For this, in order to maintain necessary temperature of hot water when the heat pump circuit starts up, there is provided a auxiliary hot-water storage tank having a capacity smaller than that of the conventional art, complementarily, thereby dissolving the problem of start-up time, further.

Accordingly, hot water is supplied instantaneously, at suitable or proper temperature with using high-temperature hot water stored in the hot-water storage tank, when rising up the operation, and after when the heat-pump operation reaches to a stable operation enabling to supply hot water of temperature at a desire, hot water is directly supplied by the hot water circuit, while stopping the hot-water supply from the hot-water storage tank; i.e., combining with the structure according to the present invention, enabling to reduce an amount of refrigerant residing within the evaporator, makes possible to prevent heating power from being lowered by returning of liquid just after starting the operation, and further shortening the rise-up time of heating.

Also, according to the present invention, since the hot-water storage tank can be minimized in the size as necessary as possible, it is possible to dissolve the drawbacks of the conventional hot-water storage type heat-pump hot water supply apparatus, and also to achieve an instantaneous type heat-pump hot water supply apparatus having the hot-water storage tank while obtaining small-size and light-weight without necessity of a compressor of large capacity. According to the present invention, it is possible to make the capacity of this hot-water storage tank to be used when the compressor starts the operation thereof, being equal to or less than 100 L, and comparing to 300-500 L of the hot-water storage tank of the conventional hot-water storage tank type heat-pump hot water supply apparatus, it is possible to obtain small-sizing down to ⅓-⅕. Therefore, it is easy to store the hot-water storage tank and the heat-pump refrigerant circuit and so on into a same box, and thereby dissolving various problems when actually installing, such as, an installation are, an installation strength, connection of water pipes between the main body of hot water supply apparatus and the heat-pump main body, etc.

It is also possible to apply an electromotive expansion valve to the refrigerant adjusting device in the heat-pump hot water supply apparatus mentioned above, according to the present invention. Differing from that of opening/closing the valve due to the expanding power thereof by conducting electricity through a heater, like a thermal type expansion valve, a stepping motor is driven, immediately, depending on the instruction of number of pluses generated by the operation controller means, so as to adjust a valve mechanism portion thereof into a predetermined opening, and thereby enabling to close the electromotive exposition valve at the same time when receiving a signal of stopping operation, and making a timing relating to stoppage of the compressor and time controls easy. And, it is further possible to obtain effects of shortening the operation rise-up time and of improving the re-starting characteristic when it is in the low-temperature sleep.

Also, the refrigerant adjusting device in the heat-pump hot water supply apparatus mentioned above, according to the present invention, may be made up with an electromagnetic two-way valve and a capillary tube. For the electromagnetic two-way valve, since it is enough to have only functions of fully open when operating and fully-close when stopped; therefore, an amount of leakage of refrigerant can be made extremely small, when it is closed, with a simple structure of applying a ball valve, etc., therein, and enables collection of refrigerant in the evaporator with certainty.

According to the present invention, with the heat-pump hot water supply apparatus, it is possible to improve the rise-up characteristic when starting the operation thereof, and thereby obtaining an increase of usability thereof. In particular, according to the present invention, it is possible to achieve a remarkable effect within an instantaneous heating type heat-pump hot water supply apparatus of tapping hot water from a hot-water taping terminal, which is heated up to a predetermined temperature of tapping hot water within the water/refrigerant heat exchanger, by starting the compressor upon detection of tapping of hot water.

BRIEF DESCRIPTION OF THE SEVERAL VIEWS OF THE DRAWING

Those and other objects, features and advantages of the present invention will become more readily apparent from the following detailed description when taken in conjunction with the accompanying drawings wherein.

DETAILED DESCRIPTION OF THE INVENTION

Hereinafter, embodiments according to the present invention will be fully explained by referring to the attached drawings.

Figure 1:
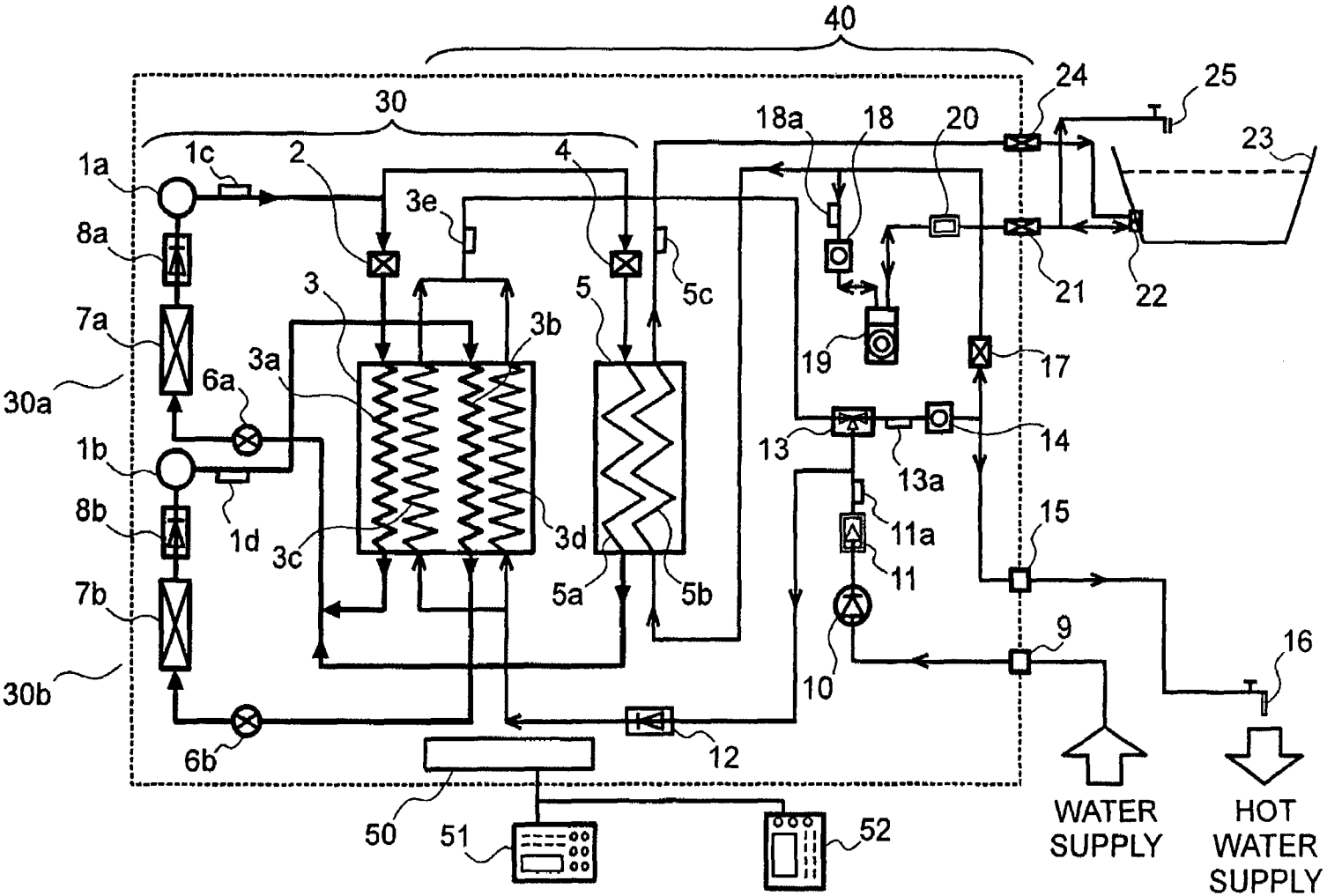
FIG. 1 is a block diagram for showing a first embodiment of the heat-pump water heater, according to the present invention, but without provision of a hot-water tank.

In FIG. 1, a heat-pump water heater, according to one embodiment of the present invention, comprises a heat-pump refrigerant circuit 30, a hot-water supply circuit 40, and an operation controller means 50.

The heat-pump refrigerant circuit 30 and the hot-water supply circuit 40 can be received within the same box or housing as a unit. Also, the operation controller means 50 is connected to a kitchen remote controller 51 and a bathroom remote controller 52, which are provided separately.

The heat-pump refrigerant circuit 30 is of so-called a two (2) cycle method, having an each of parts by two (2) pieces, and is constructed with compressors 1*a* and 1*b*, refrigerant-side heat conducting pipes 3*a* and 3*b*, which are provided in a water/refrigerant heat exchanger 3, refrigerant adjusting valves 6*a* and 6*b*, evaporators 7*a* and 7*b*, and valves for preventing back-flow (back-flow or check valves) 8*a* and 8*b*, connecting each thereof in series through refrigerant conduits or pipes.

As a refrigerant to be enclosed within each of the respective cycles, fluoride carbon hydride may be applied, preferably, but including no chlorine therein, or as a natural refrigerant, such as, carbon dioxide, for example.

Within the cycle having the compressor 1*a*, between those two cycles of the heat-pump refrigerant circuit 30, there is further provided a circuit communicating to a heat exchanger 5 for use in bath, for heating the hot water of the bathtub 23, additionally.

This refrigerant cycle for use of additional heating of bathtub water enables the additional heating of hot water of the bathtub 23 through the bath-use heat exchanger 5, because the high-temperature refrigerant passes through the refrigerant pipe, which is branched or divided from the refrigerant pipe provided between the compressor 1*a* and the water/refrigerant heat exchanger 3 and is connected to the refrigerant pipe 5*a* for use of both provided within the bath-use heat exchanger 5. The both-use refrigerant pipe 5*a* is also connected to the refrigerant pipe, which is branched or divided from the refrigerant pipe provided between the refrigerant-side heat conducting pipes 3*a* and 3*b* of the water/refrigerant heat exchanger 3 and the refrigerant adjusting valve 6*a*.

On the way of the series of refrigerant pipes communicating to the bath-use heat exchanger 5, there is provided a second refrigerant open/close valve 4. Preferably, this second refrigerant open/close valve 4 is provided on the both-use refrigerant pipe 5*a*, which is divided from the refrigerant pipe between the compressor 1*a* and a first refrigerant open/close valve 2.

In the present embodiment, the first refrigerant open/close valve 2 is also provided on the refrigerant pipe connecting to the water/refrigerant heat exchanger 3 of the cycle, which has the compressor 1*a*. Exchanging the refrigerant channel between the first refrigerant open/close valve 2 and the second refrigerant open/close valve 4 prevents the high-temperature refrigerant from flowing into the both-use refrigerant pipe 5*a*, i.e., lowering the capacity, in particular, when supplying hot water.

Those compressors 1*a* and 1*b* are so large in the capacity that they can be adapted to the instantaneous type heat-pump water heater, and they are the compressors of a capacity control type, being changeable in the rotation speed depending upon an amount of supply of hot water. Those compressors 1*a* and 1*b* are controlled on the rotation speed from a low speed (for example, 700 rpm) to a high speed (for example, 7,000 rpm) through the PWM control, the voltage control (for example, the PAM control), and the control of combining those, by means of a compressor controller means (not shown in the figures).

The water/refrigerant heat exchanger 3 has the refrigerant-side heat conducting pipes 3*a* and 3*b*, which are connected with the compressor 1*a* and 1*b* through the refrigerant pipes, and also heat conducting pipes 3*c* and 3*d* of water-supply side of the hot-water supply circuit 40. And, heat exchange is conducted between those refrigerant-side heat conducting pipes 3*a* and 3*b* and those water-supply side heat conducting pipes 3*c* and 3*d*. Preferably, those compressors 1*a* and 1*b* have capacities equal to 23 kW or more, from a practical view point, so that they can heat water by using two (2) cycles, for example, under the condition of the middle term; i.e., 16° C. of open-air temperature and 17° C. of water temperature.

In general, a capillary, an expansion valve of thermal type, an electromotive expansion valve, or the like may be adopted to those refrigerant adjusting valves 6*a* and 6*b* to be connected with the refrigerant-side heat conducting pipes 3*a* and 3*b*. The refrigerant adjusting valves 6*a* and 6*b* operate to reduce the pressure of high-pressure refrigerant of intermediate- (or middle-) temperature supplied through the water/refrigerant heat exchanger 3, by the operation controller means 50, so as to send out low-pressure refrigerant, which can be easily evaporated, into the evaporators 7*a* and 7*b* through the refrigerant pipes.

And, those refrigerant adjusting valves 6*a* and 6*b* are apparatuses for adjusting flows of refrigerant, also having function of adjusting a flow-rate of refrigerant circulating within the heat-pump circuit 30 by changing throttle volume within the refrigerant passages, as well as, a role as a defroster for melting frosts, supplying a large amount of refrigerant of the middle-temperature to the evaporators 7*a* and 7*b* by fully opening the throttle volumes.

Further, the refrigerant adjusting valves 6*a* and 6*b*, according to the present embodiment, have also a full-close function, in addition to the functions of the conventional pressure-reducing valve. Though mentioning the details thereof later, they close or shut off the refrigerant passages responding to stoppage of the compressors 1*a* and 1*b*, upon basis of an instruction from the operation controller means 50. With doing this, they contribute to collect the refrigerant within the evaporators 7*a* and 7*b* to a side of the compressors 1*a* and 1*b*.

Also, when the heat-pump circuit 30 is operated, again, an instruction of opening the refrigerant passage is given from the operation controller means 50, before the compressors 1*a* and 1*b* start the operations thereof, the compressors 1*a* and 1*b* reduce the discharging pressures thereof, so as to obtain a pressure balance; thereby making the re-start of the compressors 1*a* and 1*b* easy. For the purpose of responding to an open/close instruct on signal, it is most suitable to apply an electromotive expansion valve or an electromagnetic two (2)-way valve, having fast responding speed.

However, when applying the electromagnetic two (2)-way valve to be the refrigerant adjusting valves 6*a* and 6*b*, a capillary tube is needed for reducing the pressure of refrigerant, together with the electromagnetic two (2)-way valve for conducting the open/close operation for refrigerant.

The evaporators 7*a* and 7*b* build up an air/refrigerant heat exchanger for achieving heat exchange between an air and the refrigerant. Through adjustment on an amount of air supply by means of a fan not shown in the figures, it is also possible to change an amount of heat exchange in the evaporators 7*a* and 7*b*.

A hot water supply circuit 40 comprises a water circulating circuit for achieving hot-water supply through a cock, hot-water supply to a bathtub, and additional heating of the bathtub.

A hot water supply circuit for a kitchen cock has a water supply pipe and a hot-water supply pipe for kitchen. The water supply pipe is connected to a metal part 9 for obtaining connection with a water supply duct, being a water supply source in an outside of the apparatus, such as, a water service, etc., and also to the heat conducting pipes 3*c* and 3*d* of water-supply side of the water/refrigerant heat exchanger 3. The kitchen hot-water supply pipe is connected to the heat conducting pipes 3*c* and 3*d* of water-supply side of the water/refrigerant heat exchanger 3, and also to a metal part 15 for tapping hot water in kitchen, which is communicated with a kitchen cock 16, e.g., one of hot-water tapping terminals outside the apparatus.

On the way of this water supply pipe are provided a pressure reducing valve 10, a water-supply amount sensor 11 for measuring an amount of water supplied, and a water-check valve 12, in series.

And on the way of hot-water supply pipe are provided a water/hot-water mixing valve 13 and a flow rate adjusting valve 14 for adjusting the flow rate of hot water to be tapped or supplied.

The pressure reducing valve 10 is provided for the purpose of controlling the high water pressure fluctuating from 200 to 500 kPa, which is supplied from the water supply source, such as, the water service, for example, to a constant water pressure of about 170 kPa, suitable to be used. The water check valve 12 allows the water to flow into only one direction, thereby preventing it from flowing into the reversed direction.

A bathtub hot-water supply circuit has a water supply pipe in common with the kitchen cock hot-water supply circuit, and in addition of that water supply pipe, it also has a bathtub hot-water supply pipe, which is connected between the refrigerant-side heat conducting pipes 3*a* and 3*b* of the water/refrigerant heat exchanger 3 and a hot-water in/out metal part 21. The hot-water in/out metal part 21 is connected with a circulation adapter 22 for bath attached on a bathtub through a water supply pipe.

To the bath hot-water supply pipe are provided the water/hot-water mixing valve 13, the flow rate adjusting valve 14, a bath hot-water pouring valve 17 to be opened when hot water is supplied into the bathtub 23, a flow switch 18 for detecting the direction of water flow, a bath circulation pump 19 to be operated when heating the hot water of the bathtub, additionally, and a water level sensor 20 for detecting the level of the hot water stored within the bathtub, in series.

An additional heating circuit for bath has duplication with the bath hot-water supply pipe of the bath hot water supply circuit, in a part thereof. It is a pipe reaching from the hot-water in/out metal part 21 to the flow switch 18, and further being divided from the bath hot-water supply pipe to the bathtub hot-water pouring valve 17, to be connected with the bath-use water pipe 5*b* of the bath-use heat exchanger 5, thereby being connected from that bath-use water pipe 5*b* to a metal part 24 for supplying hot water to the bathtub through the water pipes.

Further, the hot-water in/out metal part 21 is connected to the bathtub 23 through the bath-use circulation adapter 22, and is also connected to the bath cock 25 and/or a shower (not shown in the figures). Through this hot-water in/out metal part 21, the hot water is supplied from a side of the water level sensor 20 to a side of the bathtub 23 and the bath cock 25 when supplying hot water to the bath, and the hot water in the bathtub is taken out from a side of the bathtub 23 to a side of the water level sensor 20, by means of the both circulation pump 19, thereby making the hot water circulate, when heating the hot water in the bathtub additionally.

When burning a both additionally, i.e., heating the hot water within the bathtub additionally, the heat-pump operation is made while conducting the circulation of water within the bathtub by means of the bath additional heating circuit while operating the water circulation pump 19; i.e., the hot water remaining within the bathtub 23 is heated, and is turned back into the bathtub 23, thereby achieving the additional heating of the bathtub water.

The operation controller means 50 makes controls upon the operating/stopping of the heat-pump refrigerant circuit 30 and the rotation speeds of the compressors 1*a* and 1*b*, etc., in accordance with the operation setup by the kitchen remote controller 51 and the bathroom remote controller 52, and at the same time, achieving the operations of directly supplying hot water, filling up hot water in the bathtub, and heating hot water within the bathtub, additionally, through opening/closing of the first refrigerant open/close circuit 2 and the second refrigerant open/close circuit 4, adjusting a throttle amount of refrigerant by the refrigerant adjusting valves 6*a* and 6*b*, operating/stopping of the bath circulation pump 19, and controlling of the hot-water/water mixing valve 13, the flow rate adjusting valve 14, the bathtub hot-water pouring valve 17, and flow switch 18.

Also, the operation controller means 50 has a compressor operation controller means not shown in the figure, thereby to control the rotation speeds of the compressors 1*a* and 1*b*. The operation controller means 50 and the compressor operation controller means make such the control that the compressors 1*a* and 1*b* operate at a predetermined high rotation speed to quicken the rise-up time of heating, just after starting the operation thereof, and that the compressor 1*a* operates at a low rotation speed fitting to heating temperature when the hot water within the bathtub is heated up, additionally; i.e., when the thermal load is relatively light.

Explanation will be made about the control when the operation controller means 50 stops the hot water supply operation. The operation controller means 50 closes the refrigerant adjusting valves 6*a* and 6*b*, at first, when detecting closure of the cock or completion of filling up of hot water in the bathtub; thereby stopping the refrigerant flowing from a side of the water/refrigerant heat generator 3 into the evaporators 7*a* and 7*b*. Then, so as to collect the refrigerant within the evaporators 7*a* and 7*b* into a side of the compressors 1*a* and 1*b*, the compressors 1*a* and 1*b* are stopped after passing a predetermined time period, which is determined by internal volumes of the evaporators 7*a* and 7*b* and the rotation speeds of the compressors 1*a* and 1*b*, etc.

Further, with the predetermined time period from closure of the refrigerant adjusting valves 6*a* and 6*b* to stoppage of the compressors 1*a* and 1*b*, but depending upon an internal volume of the water/refrigerant heat exchanger 3 and/or the characteristics of the compressors 1*a* and 1*b*, it is possible to achieve an effect of reducing an amount of refrigerant residing within the evaporators 7*a* and 7*b*, fully, if they stop at the same time.

Thus, full-closing of the refrigerant adjusting valves 6*a* and 6*b*, though being in the condition of opening even during when the operation is stopped, conventionally, enables to prevent the refrigerant from flowing into the evaporators 7*a* and 7*b* from the side of the water/refrigerant heat exchanger 3 after the stoppage thereof, and thereby enabling to obtain an effect of reducing the refrigerant residing within the evaporators 7*a* and 7*b*, comparing to that in the conventional art.

Next, the operation controller means 50 changes an order in operating the compressors 1*a* and 1*b* and the refrigerant adjusting valves 6*a* and 6*b*, depending upon differences in pressures thereof between those before and after the operations of the compressors 1*a* and 1*b*, when re-starting the operations of the compressors 1*a* and 1*b*. For that purpose, it is preferable to provide pressure sensors on sucking-sides and discharging-sides of the compressors 1*a* and 1*b*. In the present embodiment, pressure sensors 1*c* and 1*d* are provided on discharging-side pipes of the compressors 1*a* and 1*b*, so as to detect the pressures at the discharging-side pressures.

The sucking-side pressures of the compressors 1*a* and 1*b* can be obtained through calculation, based on the refrigerant temperatures detected by the evaporator exit temperature sensors 7*c* and 7*d*, which are provided on the evaporators 7*a* and 7*b*.

In case when the pressure difference before and after the operations of the compressors 1*a* and 1*b* is equal to or greater than a predetermined value (for example, 2 MPa), the refrigerant adjusting valves 6*a* and 6*b* are opened, so as to bring about a balance between the high-pressure side where the water/refrigerant heat exchanger 3 is provided and the low-pressure side where the evaporators 7*a* and 7*b* are provided, and thereafter the compressors 1*a* and 1*b* are started. In this case, it is enough if the high-pressure side and the low-pressure side are not balanced completely. With those operations, the compressors 1*a* and 1*b* can be re-started, easily.

In case when the pressure difference is less than that predetermined value, the compressors 1*a* and 1*b* are started before the refrigerant adjusting valves 6*a* and 6*b* are opened. In this case, the heating operation can be started as early as possible. The fact that the pressure difference is less than that predetermined value means the evaporators 7*a* and 7*b* be in a condition where the refrigerant flows into, in no small quantities; therefore, starting the compressors 1*a* and 1*b* earlier lowers the pressure on the side of evaporators, and thereby enabling to contribute gasification of the refrigerant. Then, it is possible to reduce an amount of the liquid refrigerant, turning back to the compressors 1*a* and 1*b* when the refrigerant adjusting valves 6*a* and 6*b*.

Preferably, the difference between the time when starting the compressors 1*a* and 1*b* and the time when opening the refrigerant adjusting valves 6*a* and 6*b* is determined depending on the difference between an outside air temperature when starting the hot water supply and chamber temperatures of the compressors 1*a* and 1*b*, while calculating or estimating light/heavy of the compressor loads. Further, preferably the rotation speeds of the compressors 1*a* and 1*b* after starting the operations thereof are controlled by means of the compressor rotation speed table, in which they are set up corresponding to hot-water supply load, and preferably, openings of the refrigerant adjusting valves 6*a* and 6*b* are controlled by a refrigerant adjusting valve opening table, in which they are set up corresponding to the outside air temperature and an exit target temperature of the water/refrigerant heat exchanger 3.

As the valves for preventing back-flow 8*a* or 8*b* may be adapted a check valve or an electromagnetic two (2)-way valve, etc., for opening/closing depending on the pressure difference of the refrigerant before and after thereof. In case where the check valves are applied as the back-flow preventing valves 8*a* and 8*b*, circulation of the refrigerant can be obtained, smoothly, under the condition of full opening, since there is no pressure difference between those before and after thereof, during the operation. When the refrigerant adjusting valves 6*a* and 6*b* are closed by the function of the operation controller means 50, the refrigerant within the evaporators 7*a* and 7*b* are sucked by means of the compressors 1*a* and 1*b*, to be in the low-pressure condition, and further the compressors 1*a* and 1*b* as a whole are in the high-pressure condition when the compressors 1*a* and 1*b* stop the operations thereof. Then, the pressures before and after the check valves are: (pressures on the side of compressors 1*a* and 1*b*)>(pressure on the side of evaporators 7*a* and 7*b*), and therefore the check valve is closed.

Namely, the refrigerant adjusting valves 6*a* and 6*b* and the check valves 8*a* and 8*b* are closed, which are provided before and after the evaporators 7*a* and 7*b*, after stopping the operation, then the refrigerant hardly remain within the evaporators 7*a* and 7*b*, nor they enter therein; therefore they keep the conditions of hardly remaining the residual refrigerant therein.

Also, in case of applying the electromagnetic two-way valves as the back-flow preventing valves 8*a* or 8*b*, it is possible to select the timings of the stoppage of operation and the closures of electromagnetic two-way valves, most suitably, since the operations thereof can be controlled, freely, through electric signals from the operation controller means 50.

Selection of either one of the check valves or the electromagnetic two-way valves as the back-flow preventing valves 8*a* or 8*b*, may be made by comparison between them from viewpoints of pressure characteristics of the heat-pump circuit, costs, performances of the Within the heat-pump water heater, there are provided a water supply thermister 11*a* for detecting temperature of water supplied, a heat-exchanger thermister 3*e* for detecting temperature of the hot water from the water/refrigerant heat exchanger 3, a hot-water thermister for detecting temperature of hot water supplied, a bath thermister 18*a* for detecting temperature of water within the bathtub, pressure sensors 1*c* and 1*d* for detecting discharge pressures of the compressors 1*a* and 1*b* evaporator exit temperature sensors 7*c* and 7*d* for detecting temperatures of refrigerant at the exits of the evaporators 7*a* and 7*b*, and the water level sensor 20 for sensing the water level within the bathtub 23, etc., wherein they are so constructed that the respective detection signals are inputted into the operation controller means 50.

Next, explanation will be made about the working operations of the heat-pump water heater, according to the present invention.

Figure 2:
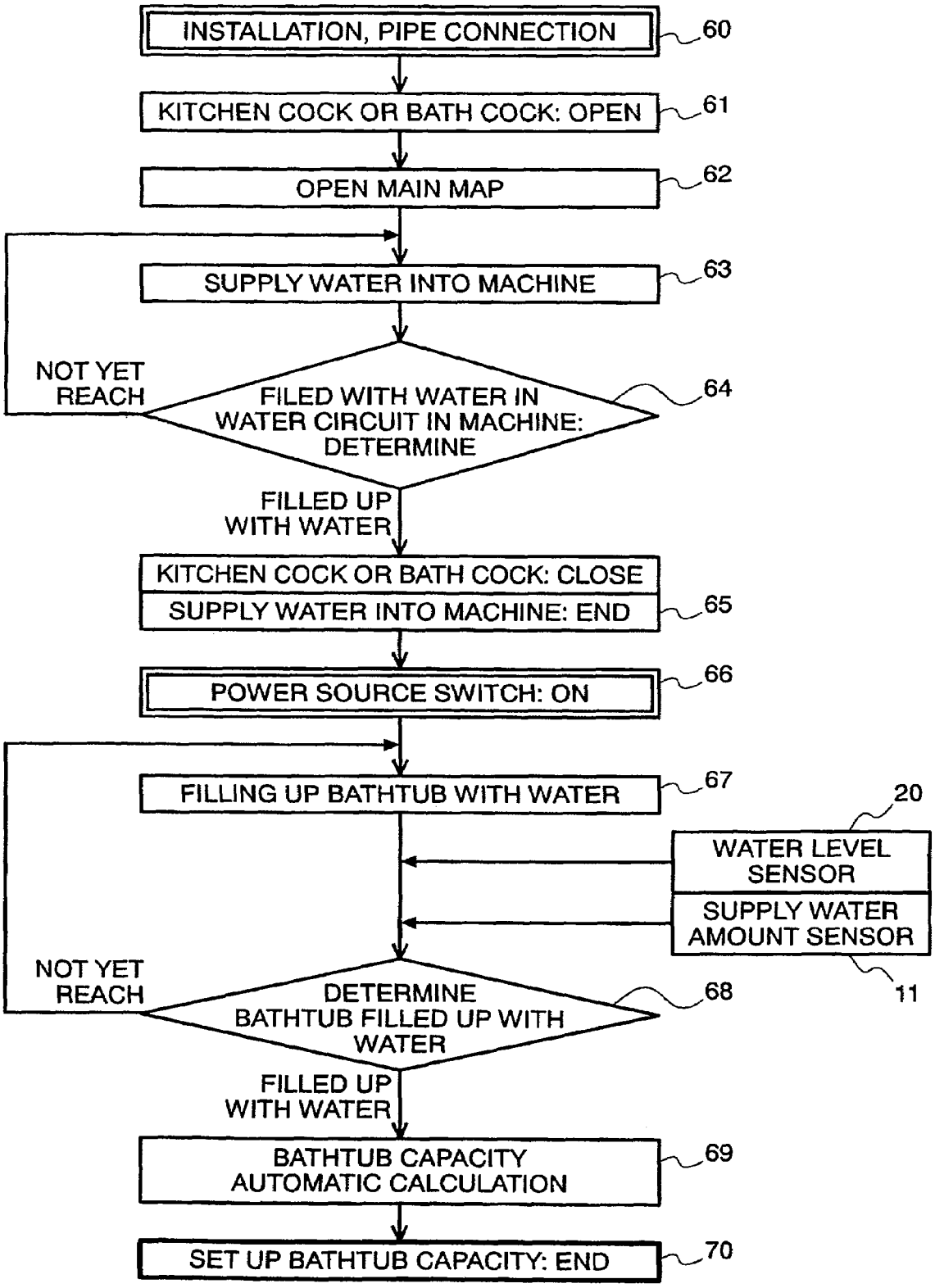
FIG. 2 is a flowchart for showing an example of a confirming operation within the heat-pump water heater according to the present invention, when it is installed and is connected with pipes therewith.

An example of operations necessary when installing the heat-pump water heater will be explained, by referring to the flowchart shown in FIG. 2.

The heat-pump water heater is transferred from the place where it is manufactured to a place for installation at the desire of a user thereof. The water supply metal part 9 is connected to the water supply source, such as, the water works, the kitchen hot-water tapping metal part 15 to the kitchen cock 16, the hot-water in/out metal part 21 to the bath-use circulation adapter 22 and the bath cock 25, and the bath hot-water supply metal part 24 to the bath-use circulation adapter 22, through water pipes (step 60). Thereafter, the kitchen cock 16 or the bath cock 25 is opened for removing airs therein (step 61), and a main tap of the water supply source is opened (step 62).

Water supply is started from the water supply source into the machine, and then the water flows into the water/refrigerant heat exchanger 3 and the respective water pipes, after being reduced in the pressure thereof, to be adjusted at a constant pressure by means of the pressure reducing valve 10 (step 63). After confirming the condition that the water circuits are filled up with water, by checking flowing out of water from the kitchen cock 16 or the bath cock 25 (step 64), the kitchen cock 16 or the bath cock 25 is closed, and the water supply into the machine is completed (step 65).

However, the respective equipments are set into the following initial conditions, when the heat-pump water heater is installed. The hot-water/water mixing valve 13 is in the condition of being opened in three (3) directions, the flow rate adjusting valve 14 in the condition of being fully opened, and the bathtub hot-water pouring valve 17 in the condition of being fully closed, respectively.

Next, an electric power switch is turned on (step 66), and then an operation will be made for filling up the bathtub with water (step 67).

In the operation of filling up the bathtub with water, the bathtub hot-water pouring valve 17 is opened for pouring water into the bathtub 23, until the time when it is filled up to the brim thereof, and determination will be made on filling-up of with water (step 68). While detecting the water level and the water amount within the bathtub 23 by means of the water level sensor 20 and the water-supply amount sensor 11, the operation controller means 50 automatically calculates the relationship between the total capacity and the water amount of the bathtub 23 and the water level (step 69), and sets up a proper amount of water in the bathtub, and a proper amount of change due to additional amount of water (step 70). Those setup values will be put into practical use, for example, when filling up the bathtub with hot water and/or when adding hot water into the bathtub, in the automatic operations of bath after the setup of those. Accordingly, the operation of filling up the bathtub with water mentioned above is necessary, but only once when setting the heat-pump water heater.

Figure 3:
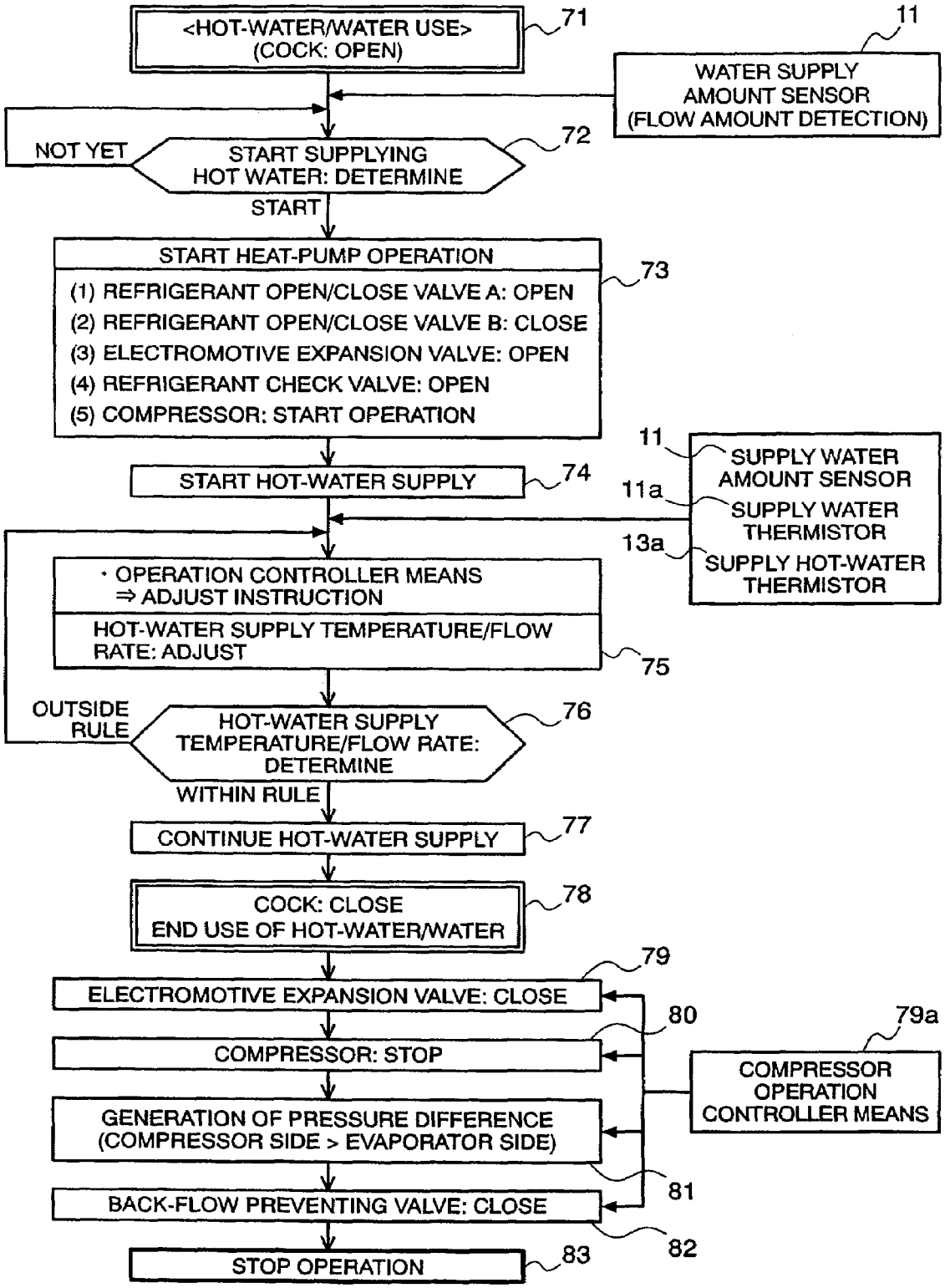
FIG. 3 is a flowchart for showing an example of an operation within the heat-pump water heater according to the present invention, when it supplies hot water.

Next, FIG. 3 is an example of a flowchart for showing the operations when using hot water by opening the kitchen cock 16.

When using of hot-water/water is started by opening the kitchen cock 16 (step 71), the water-supply amount sensor 11 detects the flow rate and the operation controller means 50 determines start of supplying hot water (step 72), and if the flow rate is equal to a certain rate or greater than that, determination is made on start of supplying hot water. The operation controller means 50 initiates the compressors 1*a* and 1*b*, so as to start the heat-pump operation (step 73), thereby beginning the supply of hot water by means of the kitchen cock hot water supply circuit mentioned above (step 74).

In the step 73, the operation controller means 50 executes the following controls. First of all, opening the first refrigerant open/close valve 2 and the refrigerant adjusting valves 6*a* and 6*b* of the heat-pump refrigerant circuit 30, as well as, starting the compressors 1*a* and 1*b*, the high-temperature and high-pressure refrigerant compressed is circulated. Due to starting of operations of the compressors 1*a* and 1*b*, the pressures before and after the back-flow preventing valves 8*a* and 8*b* are changed into the relationship, i.e., (pressure on the side of compressors 1*a* and 1*b*)<(pressure on the side of evaporators 7*a* and 7*b*), and therefore the back-flow preventing valves 8*a* and 8*b* are changed from the closed condition into the opened condition. In this manner, the refrigerant is able to circulate within the heat-pump circuit, and therefore the heat-pump operation is conducted continuously.

Although the high-temperature and high-pressure refrigerant compressed by the compressors 1*a* and 1*b*, is sent into the refrigerantide heat conducting pipes 3*a* and 3*b* of the water/refrigerant heat exchanger 3, and after heating the supplied water flowing within the water supply-side heat conducting pipes 3*c* and 3*d*, it flows out into the direction of hot-water/water mixing valve 13. However, the refrigerant sent into the water/refrigerant heat exchanger 3 is still low in the temperature thereof, since it does not yet reach to high-temperature and high-pressure, and also the entire of the water/refrigerant heat exchanger 3 is cooled down; therefore, the water/refrigerant heat exchanger 3 has not sufficient heating power enough for heating water.

The refrigerant comes to be high in the temperature and high in the pressure, gradually, accompanying with elapse of time, and in accordance with this, an amount of heat-generation generated from the refrigerant goes up, while increasing the heating capacity to water, wherein a length of time for starting or rising up the operation, i.e., from starting of that operation up to the time when the hot water to be supplied reaches to the proper temperature (for example, about 42° C.), is called by "operation rise-up characteristic" or "heating rise-up characteristic".

For achieving instantaneous hot-water supply by directly supplying hot water heated through the heat-pump operation, but having no hot-water storage tank, the operation rising up characteristic mentioned above is the most fundamental and important problem to be dissolved, the details of which will be mentioned later by referring to FIG. 4.

After starting the hot-water supply operation (step 74), the operation controller means 50 makes adjustments upon the temperature and the flow rate of hot-water to be supplied (step 75), depending on the detection data of the water-supply amount sensor 11, the water-supply thermistor 11*a*, and the hot-water supply thermistor 13*a*, and thereby continuing the hot-water supply operation at the proper temperature and proper flow rate.

Further, the determinations upon the temperature and the flow rate of hot-water supplied are always conducted (step 76), and if they are within the predetermined rule or values, the supply of hot water is continued up to the time when the cock is closed (step 77).

When the kitchen cock 16 is closed, i.e., use of hot water is ended (step 78), the operation controller means 50 firstly closes the refrigerant adjusting valves 6*a* and 6*b* (step 79), at first, and after passing a predetermined time period, it stops the operations of the compressors 1*a* and 1*b* (step 80). With those steps, the differences in pressure between those before and after the back-flow preventing valves 8*a* and 8*b* are (pressure on the side of the compressors 1*a* or 1*b*)>(pressure on the side of the evaporators 7*a* or 7*b*) (step 81), so as to close the back-flow preventing valves 8*a* and 8*b* (step 82), and thereby completing the operation (step 83). However, if the back-flow preventing valves 8*a* and 8*b* are constructed with the electromagnetic two-way valves, the closing operations mentioned above are obtained through electric signals transmitted from the compressor operation 4 controller means.

Next, explanation will be made upon comparison between the case of applying the compressor operation controller means according to the present invention and the conventional case where noting is done, in FIG. 4 by referring to FIG. 1.

Figure 4:
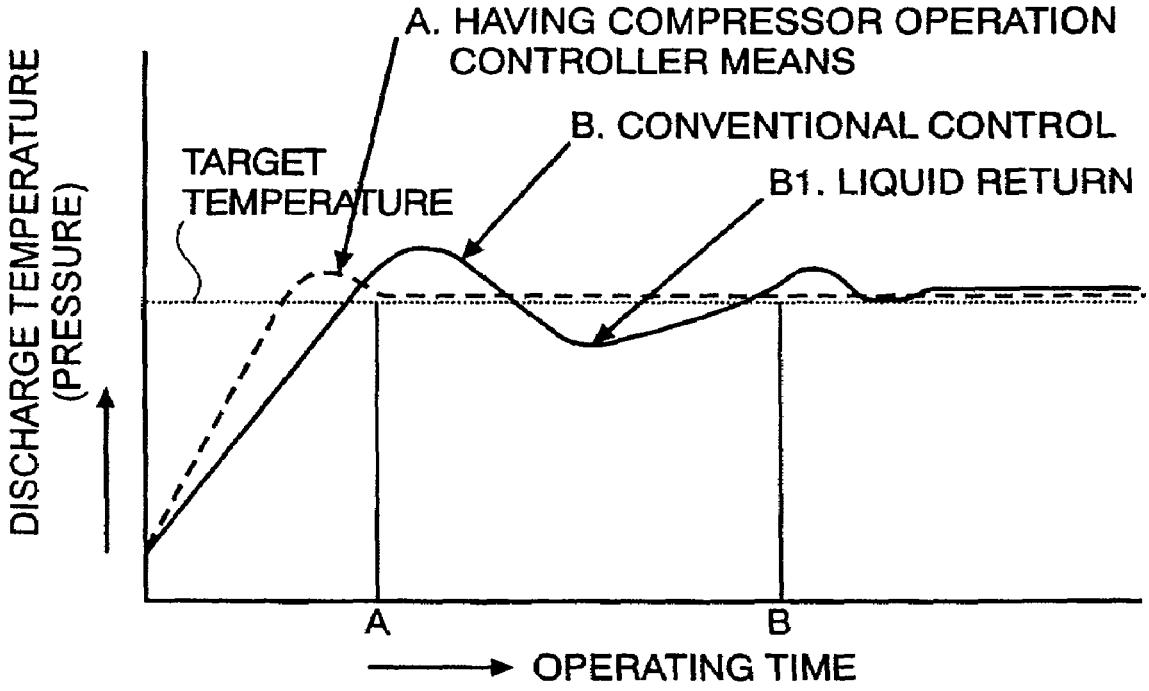
FIG. 4 shows characteristic curves for showing an example of relationship between rotation speed of a compressor and a heating capacity when controlling the rotation speed and the capacity, within the heat-pump water heater according to the present invention.

In FIG. 4, the horizontal axis depicts an operation time from starting of the heat-pump operation, while the vertical depicts temperature of the refrigerant gas discharging from the compressors, i.e., the gas compressed within the compressors 1*a* and 1*b* being high in temperature and pressure, to be discharged therefrom. This high-temperature refrigerant flowing within the refrigerant-side pipes 3*a* and 3*b* in the water/refrigerant heat exchanger 3 heats the water flowing within the water supply-side heat conduction pipes 3*c* and 3*d*, so as to supply hot water; therefore, the temperature of hot water supplied shows changes nearly equal to that of the discharging temperature on the vertical axis.

First of all, explanation will be given about the heating rise-up characteristic in relation to the conventional control where no such operation control as is provided in the present invention is made, by referring to a curve B in the figure. When the compressor 1 starts the operation, the refrigerant residing within the compressors 1*a* and 1*b* are compressed to be discharged from, becoming high-temperature and high-pressure refrigerant, and they heat the water supply within the water/refrigerant heat exchanger 3; thereby achieving the hot-water supply. At the time when the compressors 1*a* and 1*b* are stopped within the conventional operation control, the refrigerant resides within the evaporators in the form of liquid; therefore, the refrigerant come to be short within the compressors 1*a* and 1*b*, and the heating rise-up time is delayed a little bit.

Also, as is shown by an arrow B1, after reaching up to a target temperature, once, since the liquid refrigerant within the evaporators 7*a* and 7*b* turns back, suddenly, and evaporates within the compressors 1*a* and 1*b*, then the discharging temperature comes down to be lower than the target temperature, and therefore it takes a long time; i.e., the rise-up time from when the heat-pump circuit starts the operation up to it reaches to a stable operation condition of the target temperature elongates to a point B, and thereby bringing about a problem from a practical viewpoint. Also, a large amount of return of the liquid refrigerant, being an excessive load for the compressors, results into reasons of causing defects in the starting operations thereof.

Further, since the evaporators 7*a* and 7*b* are provided on an outer surface of a main body of the water heating apparatus, for achieving the heat exchange between the refrigerant and the outside air, and they go down to lowest in temperature within the heat-pump circuit 30, in particular, when the temperature is low, such as, the winter season, etc., therefore the refrigerant easily comes gathering there to reside. Although the curve of the heating raise-up characteristics shown in FIG. 4 is indicative of the low-temperature sleep operation, i.e., when the apparatus is operated, again, after elapsing six (6) hours from the stop of operation in the winter season, however the similar tendencies can be seen even also in the case when the sleep time is shorter and in the case when the peripheral temperature is high, though in spite of differences in the degrees thereof.

Next, explanation will be made about the temperature changes within the operation control according to the present embodiment, by referring to a curve A in the figure. Within the operation control of the compressors according to the present embodiment, firstly, the refrigerant adjusting valves 6*a* and 6*b* are closed, which are provided before the evaporators 7*a* and 7*b*, when the operation is stopped, so as to collect the refrigerant within the evaporators 7*a* and 7*b* into the side of compressors 1*a* and 1*b*, and then the compressors 1*a* and 1*b* are stopped.

Since the pressure difference is generated, to close the back-flow preventing valves 8*a* and 8*b*, at the same time when stopping the compressors 1*a* and 1*b*, the refrigerant hardly remains or resides within the evaporators 7*a* and 7*b* during when the operation is stopped; i.e., the refrigerant resides within the compressors 1*a* and 1*b*, sufficiently, during when the operation is stopped. This enables the compressors 1*a* and 1*b* to compress the refrigerant to be high of temperature and pressure, continuously, when the operations thereof are restarted, and therefore it is possible to obtain a smooth heating rise-up characteristic.

Thus, when starting the operations of the compressors 1*a* and 1*b*, the refrigerant residing within the compressors 1*a* and 1*b* is compressed and discharged from, in the form of the refrigerant of high-temperature and high-pressure, and it heats the water to be supplied within the water-refrigerant heat exchanger 3; thereby conducting the supply of hot water.

At the same time, since the first refrigerant open/close valve 2 and the back-flow preventing valves 8*a* and 8*b* are opened, the refrigerant circulates, continuously, through the heat-pump circuit, to which are connected the compressors 1*a* and 1*b*, the first refrigerant open/close valve 2, the refrigerant-side pipes 3*a* and 3*b*, the refrigerant adjusting valves 6*a* and 6*b*, the evaporators 7*a* and 7*b*, and the back-flow preventing valves 8*a* and 8*b*, in that order, via the refrigerant pipes; therefore, the heat exchange is conducted between the refrigerant and the water to be supplied within the water/refrigerant heat exchanger 3, and the operation is continued of supplying hot water, which was explained by referring to the flowchart of supplying hot water shown in FIG. 3.

Also, since the compressors 1*a* and 1*b* are operated at the rotation speed raised up, just after the operations thereof, for the purpose of shortening the heating rise-up time, the temperature of the hot water overshoots the target value a little bit, and thereafter it is corrected due to detection of the temperature of hot water to be supplied, by means of the hot-water supply thermistor 13*a*; therefore, the operation of supplying hot water can be conducted while maintaining the target temperature.

As was mentioned above, with the operation control and the inherent structures thereof, according to the present embodiment, there can be hardly found such phenomenon of returning liquid, as is shown by the curve B1 in the figure, and rather, the time reaching to the target temperature is fastened or shifter forward from the point B to the point A, with a smooth increase of heating temperature as is shown by the curve A in the figure. Further, it enables to shorten the heating rise-up time, greatly, and also to exclude the phenomenon of returning the refrigerant, which is the main factor of causing the defects in starting of the operation.

Figures 5, 6:
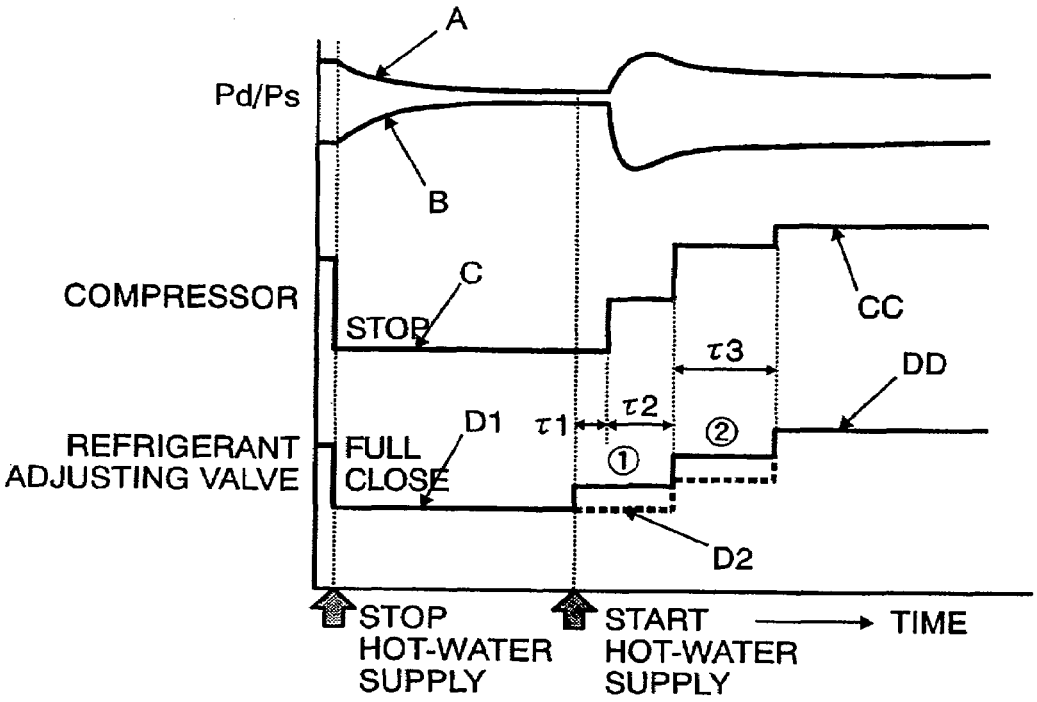
FIG. 5 shows characteristics of pressure change, operations of a compressor and a refrigerant-adjusting valve, within the heat-pump water heater according to the present invention.
FIG. 6 shows an example of a compressor rotation speed table, within the heat-pump water heater according to the present invention.

Next, by referring to FIGS. 5 and 6, further explanation will be made on the operations of the compressors 1*a* and 1*b* and the refrigerant adjusting valves 6*a* and 6*b*, in particular, when starting the operation of supplying hot water. FIG. 5 shows a chart when the compressors 1*a* and 1*b* and the refrigerant adjusting valves 6*a* and 6*b* operate at a next start of the supply of hot water, after stopping the supply of hot water. The horizontal axis depicts the elapse of time, while the horizontal axis indicates changes of the refrigerant pressures Pd and Ps at positions before and after the compressors 1*a* and 1*b*, the operation and stoppage of the compressors 1*a* and 1*b*, and the open/close of the refrigerant adjusting valves.

In case when the pressure difference A-B is equal to or greater than a predetermined value (for example, 2 MPa) between the refrigerant pressures Pd and Ps at the positions before and after the compressors 1*a* and 1*b* when starting the supply of hot water, deciding that initial loads of the compressors 1*a* and 1*b* are heavy, the compressors 1*a* and 1*b* are started after lightening the initial loads by achieving balances between the pressures at positions before and after the compressors 1*a* and 1*b* through opening the refrigerant adjusting valves 6*a* and 6*b*, as is shown by the solid line ((1) τ1=about 10 seconds).

On the other hand, in case when the pressure difference A-B is less than the predetermined value, deciding that the initial loads of the compressors 1*a* and 1*b* are light, firstly the compressors 1*a* and 1*b* are started, and thereafter, the refrigerant adjusting valves 6*a* and 6*b* are opened, as is shown by a dotted line (see D1).

Further, the time differences τ1 and τ2 between the starting times of the compressors 1*a* and 1*b* and the opening times of the refrigerant adjusting valves 6*a* and 6*b* are, preferably, to be determined upon deciding on light/heavy of the loads according to the difference between temperature of the outside air and temperature of the compressors Also, just after starting, the rotation speeds of the compressors 1*a* and 1*b* and the openings of the refrigerant adjusting valves 6*a* and 6*b* are changed, gradually, such as, τ2→τ3→CC and (1)→(2)→DD, for example; however, when the starting operations of the compressors 1*a* and 1*b* are stabilized, then thereafter, the rotation speeds of the compressors 1*a* and 1*b* are controlled upon basis of the compressor rotation-speed table, which is preset corresponding to the heating loads, as is shown in FIG. 6 by one example thereof, while the openings of the refrigerant adjusting valves 6*a* and 6*b* are controlled according to the refrigerant adjusting valve opening table (not shown in the figures), which is preset corresponding to temperature of an outside air and the target temperatures at an exit of the water/refrigerant heat exchanger 3.

FIG. 6 shows an example of the compressor rotation speed table. The rotation speeds of the compressor are preset by using the heating load condition, taking the temperature of water supplied into the water heating apparatus and the temperature of hot water to be supplied from the heat-pump circuit after heating that therein.

For example, in case of use in kitchen, in particular, in the winter season, the rotation speed of the compressor is set or determined to 4,000 rpm, for example, for heating the water of 9° C. up to 42° C., to be supplied, however in case of the operation of storing hot water, the rotation speed of the compressor is set to 5,000 rpm, for heating the water of 9° C. up to 60° C., to be supplied, though even in the same winter season.

Further, determination of the rotation speed of the compressor is made by taking the heating capacity of the heat-pump when supplying hot water, etc., into the consideration. Since the operation controller means controls the rotation speeds of compressors by means of the compressor rotation speed table, which is determined corresponding to the load of supplying hot water, and also controls the openings of the refrigerant adjusting valves by means of the refrigerant adjusting valve opening table, which is determined corresponding to the outside-air temperature and the target temperature at an exit of the water/refrigerant heat exchanger; therefore, the rotation speeds of the compressors and the openings of the refrigerant adjusting valves can be adjusted, corresponding to the loads of supplying hot water; i.e., differences in temperatures of hot-water to be supplied depending on the ways of use thereof, such as, the operation of directly supplying hot water and the operation of storing hot water, etc., as well as, taking the outside-air temperature into the consideration, and therefore, it is possible to reach the target temperature of supplying hot water, as soon as possible.

In this manner, the operation control explained in the present embodiment is the control of using the most of work or power, being stored in the form of pressure difference of the refrigerant during operation of the heat-pump circuit, in the next operation, keeping it as far as possible, and it contributes to high efficiency of the heat-pump water heater.

Figure 8:
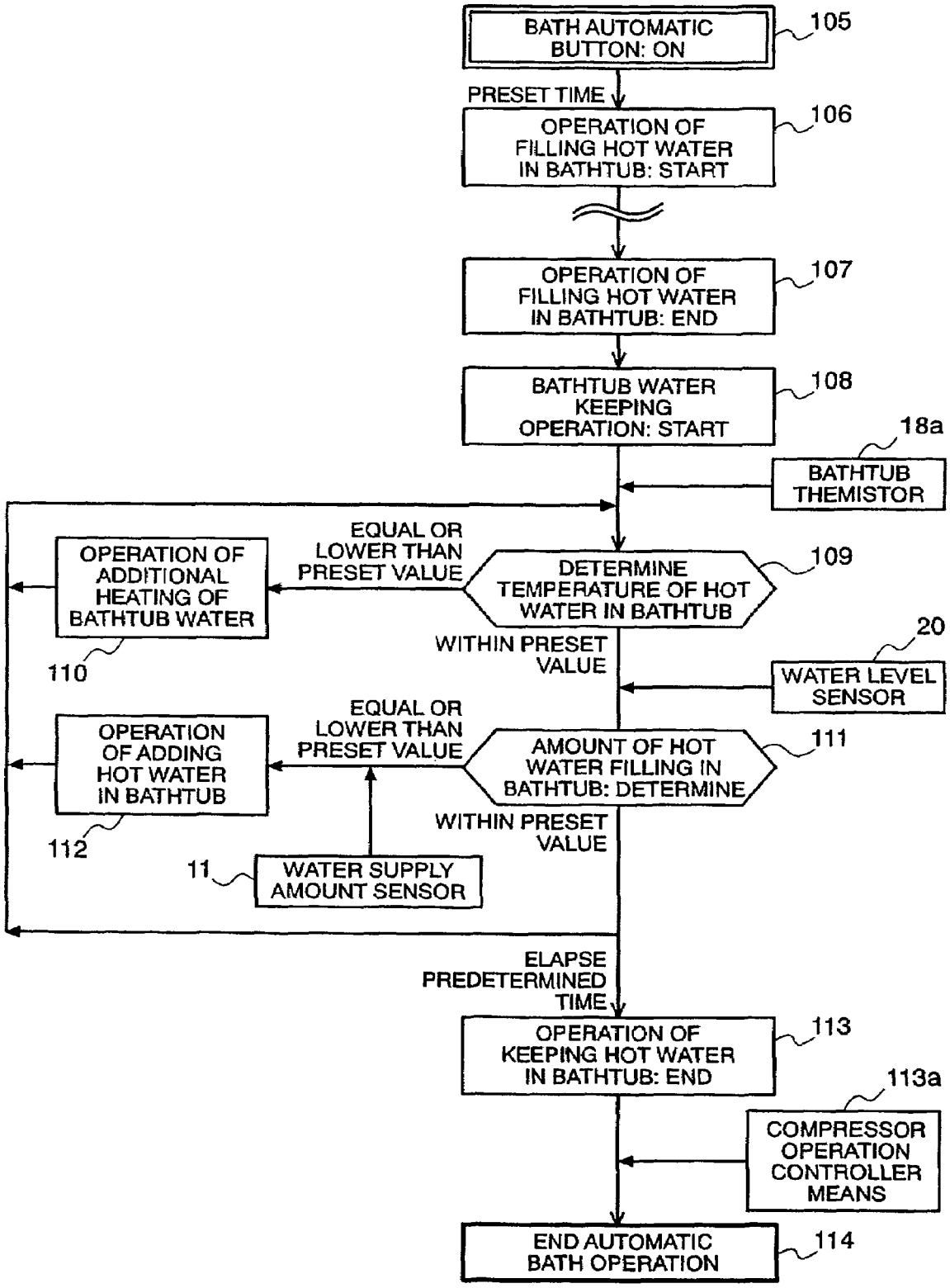
FIG. 8 is a flowchart for showing an example of operation when keeping hot water temperature of the bathtub in the automatic bath operation, within the heat-pump water heater according to the present invention.

Next, FIG. 8 shows an embodiment of the flowchart, in particular, for showing the operation of filling up hot water into the bathtub in the automatic bath operation.

While pushing an automatic both button to be "ON" (step 91), and when it comes to the preset time, the operation of filling up hot water into bathtub is started (step 92), and then, the bathtub hot-water pouring valve 17 is opened, thereby conducting the supply of hot water into bathtub (step 93).

In the supply of hot water into bathtub (step 93), the heat-pump operation is made, in the similar manner to the use of supplying hot water, as is explained in FIG. 3, but the hot water is supplied into the bathtub, in the place of the kitchen cock 16, by means of the bathtub hot-water supplying circuit.

Also, during the operation of supplying hot-water into bathtub, the temperature of hot water to be supplied into the bathtub is detected by the bathtub thermistor 18*a*, so as to make determination upon the temperature of hot water to be supplied (step 94). If it is outside a predetermined rule or limits, an adjustment is made on the temperature thereof (step 94*a*), and if it is within the predetermined rule or limits, the supply of hot water is continued (step 95).

Furthermore, the water level within the bathtub is detected by means of the water level sensor 20, and determination is made upon an amount of water filled up within the bathtub (step 96).

As far as it is decided to be outside a predetermined rule or limits in the determination (step 96) made on the amount of water filled up within the bathtub, the supply of hot water is continued (step 95), and when it reached into the predetermined rule or limits, the supply of hot water into the bathtub and the heat-pump operation are stopped (step 97). The compressor operation controller means 98*a* closes the refrigerant adjusting valves 6*a* and 6*b* (step 98), at first, and then stops the compressors 1*a* and 1*b* after passing a predetermine time period (step 99), thereby the pressure differences between those before and after the refrigerant check valves are, (pressure on the side of the compressors 1*a* or 1*b*)>(pressure on the side of the evaporator 7*a* or 7*b*) (step 100). Therefore, the back-flow preventing valves 8*a* and 8*b* are closed (step 101), and the operation is completed (step 102).

FIG. 8 shows an embodiment of the flowchart of additionally heating water within the bathtub, in the automatic both operations. While pushing the automatic bath button to be "ON" (step 105), and when it comes to a preset time, the operation is started, of filling up hot water into the bathtub (step 106), which was explained in FIG. 7. Thereafter, when the operation of filling up hot water into the bathtub is ended (step 107), the operation of keeping temperature of hot water within the bathtub is started (step 108).

After starting the operation of keeping temperature of hot water within the bathtub (step 108), the temperature of hot water is detected by the both thermistor 18*a*, and if it is determined to be within the predetermined value in the determination of temperature of hot water within the bathtub (step 109), the operation of keeping temperature of hot water within the bathtub is continued, on the other hand if it is determined to be equal or lower than the predetermined value, then the operation is conducted, of additionally heating hot water within the bathtub (step 110).

An amount of hot water within the bathtub is detected every time when elapsing a predetermined time (for example, 10 minutes), by means of the water level sensor 20, and if it is determined to be within a predetermined value in the determination of the amount of hot water filled up within the bathtub (step 111), then the operation of keeping temperature of hot water within the bathtub is continued, on the other hand if it is determined to be equal or lower than the predetermined value, then the operation is conducted, of adding hot water into the bathtub (step 112).

Further, when elapsing a preset time of the automatic both operations, the operation of keeping temperature of hot water within the bathtub is ended (step 113), and the automatic both operation is completed (step 114).

Figure 7:
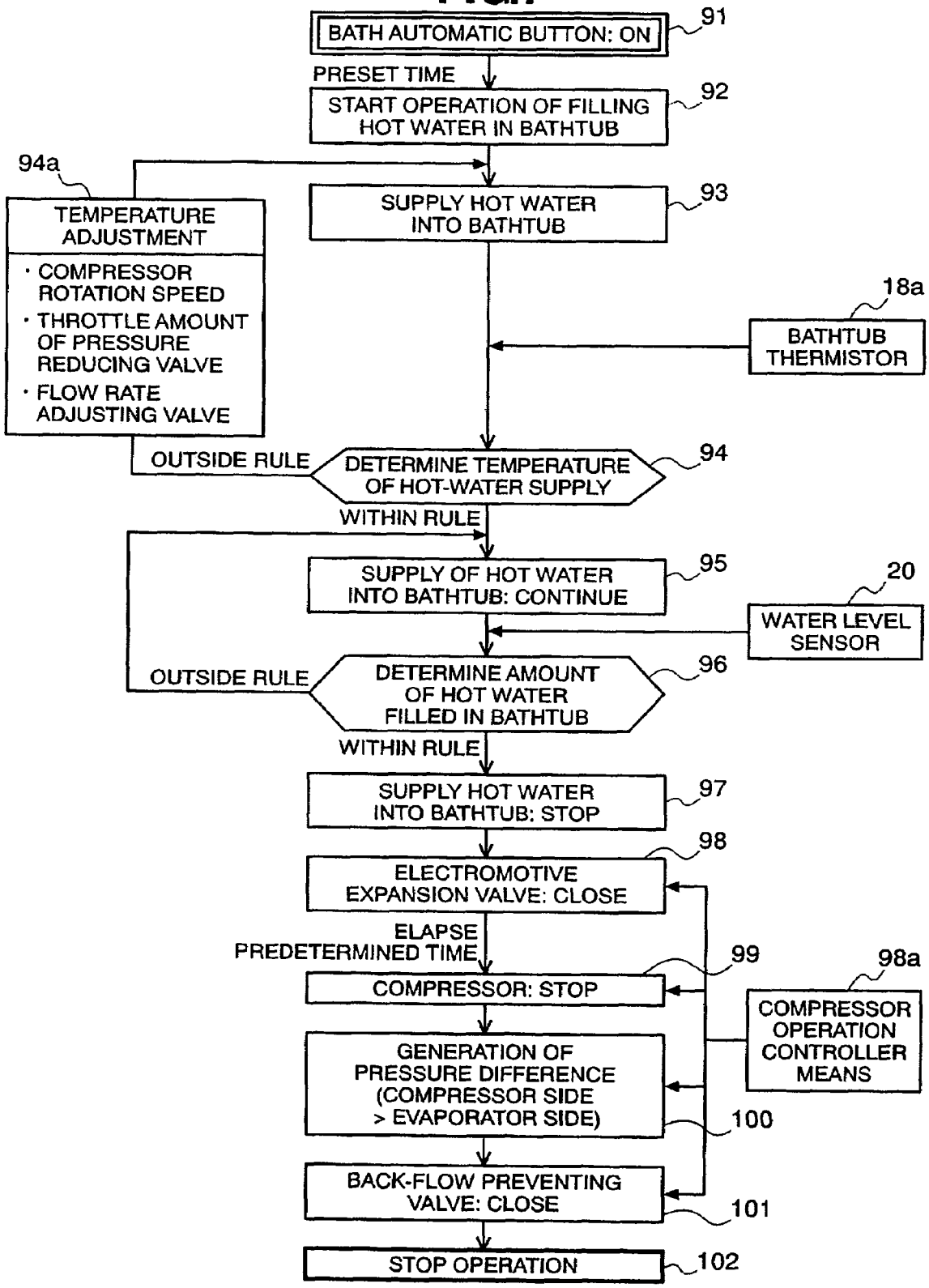
FIG. 7 is a flowchart for showing an example of operation when supplying hot water into a bathtub in an automatic bath operation, within the heat-pump water heater according to the present invention.

Further, when the operation of keeping temperature of hot water within the bathtub is ended (step 113), the compressor operation controller means 113*a* makes the operation stopping control in the manner completely same to that in the case, which is explained in FIG. 7.

For achieving such the instantaneous-type heat-pump water heater without the storage tank, as was explained in FIG. 1, it is necessary to provided the compressor having a large capacity; however, with provision of a small-size storage tank of hot water, it is possible to increase up the capacity of the compressor, within a range of applying the conventional technology therein, and thereby increasing a possibility of achieving such the instantaneous-type heat-pump water heater.

Figure 9:
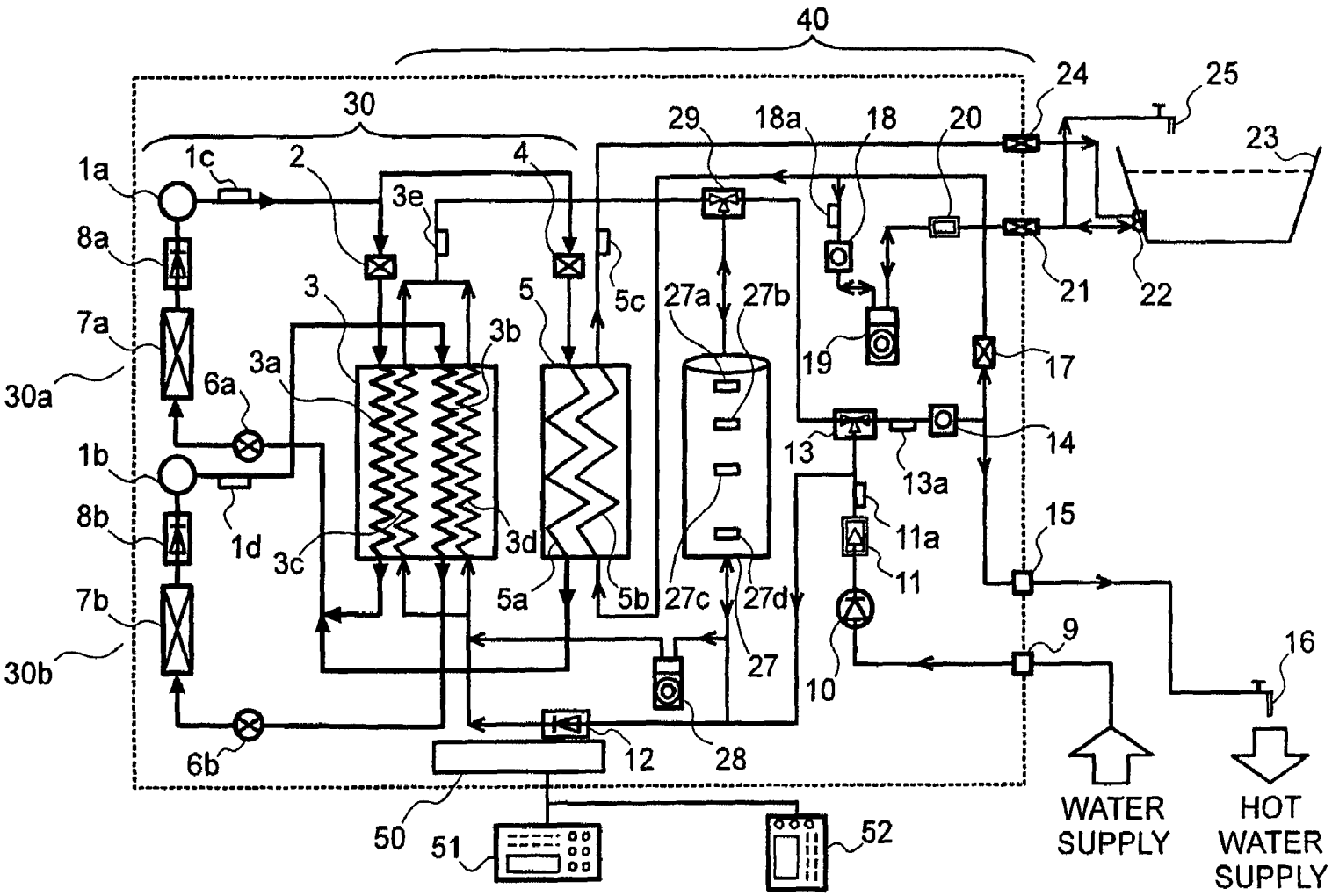
FIG. 9 is a block diagram for showing a first embodiment of the heat-pump water heater, according to the present invention, but with provision of a hot-water tank.

In FIG. 9, comparing to the heat-pump water heater shown in FIG. 1, although the heat-pump refrigerant circuit 30 is same, but within the hot-water supply circuit 40, there are added a hot-water storage tank 27 connected to before and after the water check valve 12 through the water supply pipe and the water pipe, tank thermistors 27*a* to 27*d*, which are provided in the hot-water storage tank 27, a tank circulation pump 28, which is provided within the water pipe on one side of pipes connecting between the hot-water storage tank 27 and the water supply pipe, and a tank mixing valve 29, which is provide between the water supply-side heat conducting pipes 3*c* and 3*d* and the hot-water/water mixing valve on the way of the kitchen hot-water supply pipes.

For that reason, the heat-pump water heater shown in FIG. 9 differs from the heat-pump water heater shown in FIG. 1, in the order of installation thereof. An aspect differing from lies in setting of the hot-water storage tank 27.

First of all, just after setting the heat-pump water heater shown in FIG. 9, the hot-water storage tank 27 is brought into the condition of being filled up with water, through the water supply circuit, being constructed with the water supply metal part 9, the pressure reducing valve 10, the water-supply amount sensor 11, and the hot-water storage tank 27. Thereafter, when operating the hot-water circulating pump 28, as well as, conducting the heat-pump operation, the water in a lower portion of the tank 27 drawn from the hot-water storage tank 27 is sent to the water supply-side heat conduction pipes 3*c* and 3*d* by means of the tank circulating pump 28, to be heated therein. And, the water heated therein is turned from the tank mixing valve 29, which is opened on the side of the tank 27, back to the hot-water storage tank 27. In this series of the tank circulation cycle, the water within the hot-water storage tank is heated up to a predetermined temperature.

This hot-water storage operation is conducted every time when the hot water within the hot-water storage tank 27 is used or consumed, and preferably, the hot-water storage tank 27 is so controlled that the hot water heated up to the predetermined temperature is always accumulated therein.

While always storing the high temperature water within the hot-water storage tank 27, in this manner, the high-temperature hot water is supplied from the hot-water storage tank 27, mixing with the heated water supplied from the water/refrigerant heat exchanger 3, just after starting the operation, thereby achieving auxiliary or supplemental function or role for the heating rise-up time in the heat-pump operation.

Thus, if the water supplied from the water supply-side heat conduction pipes 3*c* and 3*d* does not reach to the proper temperature, with common use of the high-temperature hot water through the mixing valve 29, it is possible to supply hot water to the kitchen cock 16 and/or the bath cock 25, as hot water heated to the proper temperature.

In case of applying the operation control mentioned above, according to the present embodiment, into the hot-water storage type instantaneous heat-pump water heater having the hot-water storage tank 27, an improvement can be made on the heating rise-up characteristics at the time when starting the heat-pump operation, and therefore, use of high-temperature water of the hot-water storage tank 27 can be made smaller in an amount thereof. Accordingly, the hot water of the hot-water storage tank 27 can be supplied, while achieving small-sizing upon the hot-water storage tank 27, therefore, it is possible to conduct the rotation speed control fitting to the preset temperature, after elapsing the starting time of the compressors certainly. Accordingly, it brings about synergistic effects of enabling to prevent the compressors from the defects in starting, in particular, in the time of the low-temperature sleep.

Also, with using the operation control explained above, according to the present embodiment, it is possible to lessen the amount of use of hot water of the hot-water storage tank 27, and also to obtain small-sizing of the capacity of the hot-water storage tank, greatly, from 300-500 L, commonly adopted in the conventional hot-water storage method, can be made small. And, loss due to heat-radiation of the stored hot water can be also reduced, greatly, comparing to that of the conventional hot-water storage method, and obtaining an effect of increasing the operation efficiency of the heat-pump water heating apparatus.

As was explained in the embodiment, the present invention is applicable into the instantaneous type heat-pump water heating apparatus with not hot-water storage tank, as well as, the instantaneous type heat-pump water heating apparatus having the hot-water storage tank, irrespective of the methods of supplying hot water, and achieving effects thereof fully. It has an effect for improvement on the operation rise-up characteristic, in particular, the instantaneous type of supplying hot water directly, without storing the hot water heated through the heat-pump operation in the hot-water storage tank.

Further, in case of applying the present invention into the conventional hot-water storage type heat-pump water heater, since it is operated one (1) time per a day during the nighttime, in particular, for the hot-water storage type, i.e., the number of interruptions is small, therefore an effect of shortening the hearing rise-up time is not remarkable; however, it has further an effect of improvement on the re-starting characteristics, such as, additional burning of a tank during the daytime, which is done urgently to deal with, for preventing the hot water from being cut off, and in particular, when it is in condition of the low-temperature sleep.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range of equivalency of the claims are therefore to be embraces therein.

What is claimed is:

1. A heat-pump hot water supplying apparatus, comprising:

a heat-pump circuit connecting a compressor, a water/refrigerant heat exchanger for conducting heat exchange between the refrigerant compressed in said compressor and water, a refrigerant adjusting device for decompressing of the refrigerant through open/close of a flow passage of the refrigerant after conducting heat exchange with the water and closing the flow passage when said compressor stops operation thereof, and an evaporator for conducting heat exchange between the refrigerant decompressed and an air, in series, through refrigerant pipes, respectively; and a hot water supplying circuit having a water supply pipe for supplying water into said water/refrigerant heat exchanger, and a hot water supplying pipe for supplying the water heated within said water/refrigerant heat exchanger;

wherein said refrigerant adjusting device opens the flow passage of the refrigerant when said compressor starts the operation thereof;

wherein an order is changed between start of operation of said compressor and opening of the refrigerant flow passage of said refrigerant adjusting device, depending upon pressure difference between discharge side pressure and suction side pressure of said compressor, when said compressor starts the operation thereof;

wherein said compressor starts the operation thereof after the refrigerant flow passage of said refrigerant adjusting device opens, when the pressure difference is equal or greater than a predetermined value between the discharge side pressure and the suction side pressure of said compressor.

2. The heat-pump hot water supplying apparatus, as described in the claim 1, further comprising a back-flow preventing valve for preventing the refrigerant from flowing from said compressor into said evaporator, within the refrigerant pipe provided between said evaporator of said heat-pump circuit and said compressor.

3. The heat-pump hot water supplying apparatus, as described in the claim 2, wherein said back-flow preventing valve is a check valve.

4. The heat-pump hot water supplying apparatus, as described in the claim 1, wherein said water supply pipe is connected with a water supply duct in an outside of the apparatus, while said hot-water supply pipe is connected with a hot-water tapping terminal in the outside of the apparatus.

5. The heat-pump hot water supplying apparatus, as described in the claim 4, further comprising a hot-water storage tank and an in-machine circulation pump, being connected through water pipes between said water supply pipe and said hot-water supply pipe, wherein said hot-water supply pipe and said hot-water storage tank are connected with through a hot-water supply mixing valve for mixing hot water heated in said water/refrigerant heat exchanger and hot water in said hot-water storage tank.

6. The heat-pump hot water supplying apparatus, as described in the claim 5, wherein at least said hot-water storage and said heat-pump circuit are received within a same box, while making said hot-water storage tank equal or less than 100 L in capacity thereof.

7. The heat-pump hot water supplying apparatus, as described in the claim 1, wherein said refrigerant adjusting device is an electromotive expansion valve.

8. The heat-pump hot water supplying apparatus, as described in the claim 1, wherein said refrigerant adjusting device is made up with an electromagnetic two-way valve and a capillary tube.

9. The heat-pump hot water supplying apparatus, as described in the claim 1, wherein said compressor further comprises a sucking side and a discharging side, the sucking side and the discharging side provided with at least two pressure sensors and at least two evaporators containing at least two exit temperature sensors;

wherein a pressure on the sucking side of said compressor obtained through calculations, based on the refrigerant temperatures detected by the evaporator exit temperature sensors of the evaporators.

10. A heat-pump hot water supplying apparatus, comprising:

a heat-pump circuit connecting a compressor, a water/refrigerant heat exchanger for conducting heat exchange between the refrigerant compressed in said compressor and water, a refrigerant adjusting device for decompressing of the refrigerant through open/close of a flow passage of the refrigerant after conducting heat exchange with the water and closing the flow passage when said compressor stops operation thereof, and an evaporator for conducting heat exchange between the refrigerant decompressed and an air, in series, through refrigerant pipes, respectively; and a hot water supplying circuit having a water supply pipe for supplying water into said water/refrigerant heat exchanger, and a hot water supplying pipe for supplying the water heated within said water/refrigerant heat exchanger;

wherein said refrigerant adjusting device opens the flow passage of the refrigerant when said compressor starts the operation thereof;

wherein an order is changed between start of operation of said compressor and opening of the refrigerant flow passage of said refrigerant adjusting device, depending upon pressure difference between discharge side pressure and suction side pressure of said compressor, when said compressor starts the operation thereof;

wherein said refrigerant adjusting device opens the refrigerant flow passage after said compressor starts the operation thereof, when the pressure difference is equal or less than a predetermined value between the discharge side pressure and the suction side pressure of said compressor.

11. The heat-pump hot water supplying apparatus, as described in the claim 10, wherein said compressor further comprises a sucking side and a discharging side, the sucking side and the discharging side provided with at least two pressure sensors and at least two evaporators containing at least two exit temperature sensors;

wherein a pressure on the sucking side of said compressor obtained through calculations, based on the refrigerant temperatures detected by the evaporator exit temperature sensors of the evaporators.

12. The heat-pump hot water supplying apparatus, as described in the claim 10, further comprising a back-flow preventing valve for preventing the refrigerant from flowing from said compressor into said evaporator, within the refrigerant pipe provided between said evaporator of said heat-pump circuit and said compressor.

13. The heat-pump hot water supplying apparatus, as described in the claim 10, wherein said water supply pipe is connected with a water supply duct in an outside of the apparatus, while said hot-water supply pipe is connected with a hot-water tapping terminal in the outside of the apparatus.

14. The heat-pump hot water supplying apparatus, as described in the claim 10, wherein said refrigerant adjusting device is an electromotive expansion valve.

15. The heat-pump hot water supplying apparatus, as described in the claim 10, wherein said refrigerant adjusting device is made up with an electromagnetic two-way valve and a capillary tube.

16. A heat-pump hot water supplying apparatus, comprising:

a heat-pump circuit connecting a compressor, a water/refrigerant heat exchanger for conducting heat exchange between the refrigerant compressed in said compressor and water, a refrigerant adjusting device for decompressing of the refrigerant through open/close of a flow passage of the refrigerant after conducting heat exchange with the water and closing the flow passage when said compressor stops operation thereof, and an evaporator for conducting heat exchange between the refrigerant decompressed and an air, in series, through refrigerant pipes, respectively; and a hot water supplying circuit having a water supply pipe supplying water into said water/refrigerant heat exchanger, and a hot water supplying pipe for supplying the water heated within said water/refrigerant heat exchanger;

wherein said refrigerant adjusting device opens the flow passage of the refrigerant when said compressor starts the operation thereof;

wherein there is a time difference between start of operation of said compressor and open of the refrigerant flow passage of said refrigerant adjusting device, when said compressor starts the operation thereof.

17. The heat-pump hot water supplying apparatus, as described in the claim 16, wherein the time difference between the start of operation of said compressor and the open of the refrigerant flow passage of said refrigerant adjusting device is changed depending upon any one of an outside air temperature when starting supply of hot water, temperature of machine body of said compressor, and pressure difference between discharge side pressure and suction side pressure of said compressor.

18. The heat-pump hot water supplying apparatus, as described in the claim 16, wherein said compressor further comprises a sucking side and a discharging side, the sucking side and the discharging side provided with at least two pressure sensors and at least two evaporators containing at least two exit temperature sensors;

wherein a pressure on the sucking side of said compressor obtained through calculations, based on the refrigerant temperatures detected by the evaporator exit temperature sensors of the evaporators.

19. The heat-pump hot water supplying apparatus, as described in the claim 16, further comprising a back-flow preventing valve for preventing the refrigerant from flowing from said compressor into said evaporator, within the refrigerant pipe provided between said evaporator of said heat-pump circuit and said compressor.

20. The heat-pump hot water supplying apparatus, as described in the claim 16, wherein said water supply pipe is connected with a water supply duct in an outside of the apparatus, while said hot-water supply pipe is connected with a hot-water tapping terminal in the outside of the apparatus.

21. The heat-pump hot water supplying apparatus, as described in the claim 16, wherein said refrigerant adjusting device is an electromotive expansion valve.

22. The heat-pump hot water supplying apparatus, as described in the claim 16, wherein said refrigerant adjusting device is made up with an electromagnetic two-way valve and a capillary tube.

23. A heat-pump hot water supplying apparatus, comprising:

a heat-pump circuit connecting a compressor, a water/refrigerant heat exchanger for conducting heat exchange between the refrigerant compressed in said compressor and water, a refrigerant adjusting device for decompressing of the refrigerant through open/close of a flow passage of the refrigerant after conducting heat exchange with the water and closing the flow passage when said compressor stops operation thereof, and an evaporator for conducting heat exchange between the refrigerant decompressed and an air, in series, through refrigerant pipes, respectively;

a hot water supplying circuit having a water supply pipe for supplying water into said water/refrigerant heat exchanger, and a hot water supplying pipe for supplying the water heated within said water/refrigerant heat exchanger; and a back-flow preventing valve for preventing the refrigerant from flowing from said compressor into said evaporator, within the refrigerant pipe provided between said evaporator of said heat-pump circuit and said compressor;

wherein said back-flow preventing valve is an electromagnetic two-way valve.

* * * * *